United States Patent [19]

Pontoppidan

[11] 4,387,063

[45] Jun. 7, 1983

[54] CARBURETTORS COMPRISING A MAIN FUEL CIRCUIT AND AN AUXILIARY CIRCUIT

[75] Inventor: Michael Pontoppidan, Chatou, France

[73] Assignee: Societe Industrielle de Brevets et d'Etudes S.I.B.E., Neuilly-sur-Seine, France

[21] Appl. No.: 262,912

[22] Filed: May 12, 1981

[51] Int. Cl.[3] ..... F02M 3/08

[52] U.S. Cl. ..... 261/41 D; 261/121 A; 261/DIG. 39; 261/DIG. 74; 261/DIG. 82

[58] Field of Search ..... 261/DIG. 39, 41 D, 121 A, 261/DIG. 74, DIG. 82

[56] References Cited

U.S. PATENT DOCUMENTS

| | | | |
|---|---|---|---|
| 2,035,636 | 3/1936 | Chandler | 261/41 D |
| 2,087,293 | 7/1937 | Olson | 261/41 D |
| 2,406,114 | 8/1946 | Sloane et al. | 261/41 D |
| 2,615,695 | 10/1952 | Winkler | 261/41 D |
| 2,694,560 | 11/1954 | Olson | 261/41 D |
| 2,852,240 | 9/1958 | Goodyear | 261/41 D |
| 2,856,168 | 10/1958 | Kittler et al. | 261/41 D |
| 3,284,066 | 11/1966 | Biver | 261/72 R |
| 3,664,648 | 5/1972 | Seeley, Jr. | 261/DIG. 39 |
| 3,868,936 | 3/1975 | Rivere | 261/41 D |
| 4,269,793 | 5/1981 | Ibbott | 261/DIG. 39 |

FOREIGN PATENT DOCUMENTS

| | | | |
|---|---|---|---|
| 2264982 | 11/1975 | France | 261/DIG. 39 |
| 2419403 | 5/1979 | France . | |
| 53-14236 | 2/1978 | Japan | 261/DIG. 39 |

*Primary Examiner*—Tim R. Miles

*Attorney, Agent, or Firm*—John T. Synnestvedt; Richard D. Weber

[57] ABSTRACT

A carburettor for an internal combustion engine comprises a main fuel supply system for normal running, opening into a venturi in the induction passage of the carburettor, and at least one auxiliary circuit for supplying a flow of air/fuel mixture for low speed and low-load operation of the engine. The mixture control means for the circuits are carried by a distribution block arranged to be inserted and removably fixed in the part of the induction passage situated in the vicinity of the venturi.

9 Claims, 2 Drawing Figures

CARBURETTORS COMPRISING A MAIN FUEL CIRCUIT AND AN AUXILIARY CIRCUIT

BACKGROUND AND SUMMARY OF INVENTION

The invention relates to carburettors for internal combustion engines of the kind comprising a main fuel delivery circuit for normal running, opening into a venturi of an induction passage, and at least one auxiliary circuit for supplying to the engine a flow of air/fuel mixture for low speed and low-load operation of the engine, said circuits comprising mixture control means. The auxiliary circuit typically opens into the induction passage through an idling port disposed downstream of a throttle, and through at least one progression or by-pass port situated so as to pass from upstream to downstream of the throttle when the latter is opened from its minimum opening position.

In conventional carburettors, the fuel-air mixture control means are formed by calibrated restrictions which meter the fuel and/or air flows and are formed in jets. In recent carburettors, the restrictions are associated with or replaced by electromagnetically controlled valves energized by electric pulses width modulated by a control circuit, which may operate in closed loop and include a detector probe immersed in the exhaust gases of the engine.

The jets and/or electromagnetic valves are usually carried by the body of the carburettor and frequently screwed into tapped passages in the body. The main fuel jet is generally disposed in the float chamber of the carburettor; an air jet (or automaticity nozzle) for brining primary air for emulsifying the fuel supplied by the main circuit, is placed in the air intake of the carburettor. The idling jet is often screwed on the external part of the moulded body of the carburettor.

The distribution of the calibrated mixture control members at different points of the carburettor presents drawbacks. During assembly of carburettors for supplying different types of engines, calibrated members corresponding to different engines are inserted into carburettor bodies; it is necessary, to satisfy the needs, to have a supply of as many completed carburettors as there are types of engine, which results in excessive inventory costs.

Moreover, experience has shown, in conventional carburettors whose jet circuit comprises an emulsion well, flow fluctuations when the circuit is primed, as well as sudden changes in the fuel flow rate on full load, which changes are presumably due to the transmission of pressure pulses along the wall.

It is an object of the invention to provide a carburettor of simple and compact construction, of reduced cost, which is easily adaptable to different types of engine.

According to the invention, there is provided a carburettor of the above-defined kind in which the mixture control means are carried by a distribution block which may be handled as a whole, arranged and dimensioned for connection to the carburettor body in the induction passage in the vicinity of the venturi thereof.

Then the primary air-fuel mixture delivered by the main fuel supply circuits elaborated close to the place where it emerges into the venturi.

When said devices are calibrated restrictions of fixed cross-sectional flow area provided in jets, the latter may be easily placed in two support arms of the block.

It will be appreciated that such a construction is fairly different from those in which a carburation block constitutes an intermediate portion of the carburettor body (U.S. Pat. No. 3,284,066) and cannot be easily replaced with another one and there is no possibility to have an inventory of standard carburettor bodies in which appropriate blocks may be located.

SHORT DESCRIPTION OF THE DRAWING

The invention will be better understood from the following description of a carburettor according to a particular embodiment, given by way of example.

DETAILED DESCRIPTION OF A PARTICULAR EMBODIMENT

Figure 1:
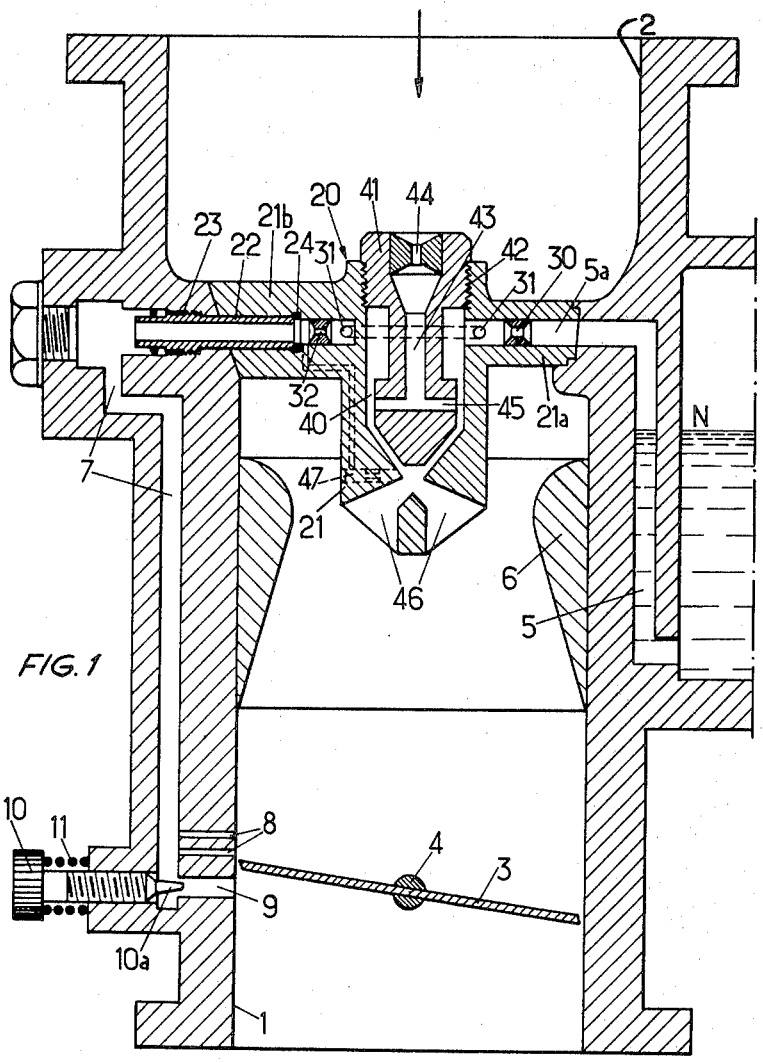
FIG. 1 is a simplified vertical section of the carburettor.
Figure 2:
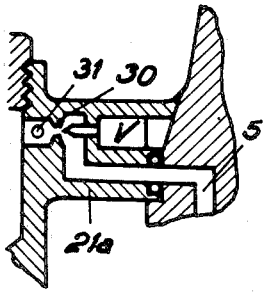
FIG. 2 is a simplified vertical cross-section of part of a distribution block constituting a modification of that shown in FIG. 1.

Referring to the figure, the carburettor, of the downdraught type, comprises a body in which is provided an induction passage 1 connected to the intake manifold of the engine, and provided with an air inlet 2. A throttle 3 or butterfly valve actuatable by the driver, mounted on a shaft 4 for pivotal movement is located in the induction passage.

The fuel supplying the engine flows from a float chamber N through a channel 5. The primary mixture (emulsioned fuel) for normal running passes through a main fuel supply circuit opening into the induction passage 1 at the throat of a venturi 6, whereas the amount of primary mixture required for idling or for low load running of the engine is delivered by an auxiliary circuit. The auxiliary circuit comprises, in its downstream part, a channel 7 which opens into intake pipe 1 through:

at least one by-pass port 8 located so as to pass from upstream to downstream of the butterfly valve 3 when the latter is opened, even slightly, from its minimum opening position.

and an idling port 9 situated downstream of butterfly valve 3 and whose flow cross-sectional area is defined by the end part 10*a* of an adjusting screw 10, restrained by a spring 11.

The carburettor comprises a single distributor block 20 which meters fuel delivered to:

a main fuel jetting system, the idling channel 7.

The distributor block 20 comprises a hollow cast part 21 secured in the air inlet 2 of the carburettor. Part 21 has a central cylindrical portion and a plurality of radial arms (two arms in the illustrated embodiment) which bear on the body of the carburettor through inclined surfaces.

One of the arms 21*a* is used for flowing fuel from the float chamber. The other 21*b* is used for supplying the auxiliary circuit with fuel. Part 21 is held in place by a hollow screw 22 projecting into arm 21*b* and whose threaded portion cooperates with a threaded opening 23 in the body of the carburettor. The end portion of screw 22 bears on part 21 through an O-ring seal 24.

The hollow part 21 provides a fluid connection between the float chamber N and the main and idling circuits. It comprises a common branch formed by channel 5 and a duct 5*a* formed in arm 21*a* and in which is force fit a main jet 30.

Starting from main jet 30, the auxiliary circuit comprises, in part 21, a circumferential duct 31 and a idling jet 32 which opens into the passage provided inside the hollow screw 22.

From the same main jet, the main circuit comprises an annular passage defined, in a central cavity 40 of part 21, by an air supply end-piece or fitting 41. End-piece 41 is screwed inside cavity 40 in an internally threaded portion 42 of part 21. End-piece 41 has therethrough a central passage in which is force fit an automaticity nozzle formed with a calibrated hole 44. Passage 43 connects the air inlet 2 of the carburettor to the central cavity 40 through one or more radial holes 45. Cavity 40 opens into the induction passage through apertures 46 situated at the level of the main venturi 6.

A duct 47 may be formed in part 21 for providing a passage between a zone downstream of the lower end of end piece 41 and channel 7. That duct, provided with a calibrated restrictor, sucks the fuel drops which may adhere to the end and whose aspiration by the air intaken by the engine could result in operating jerks.

Operation is as follows: when the engine is idling, butterfly valve 3 is closed (as shown in the figure) and a considerable amount of depression prevails in port 9. The corresponding depression in the idling circuit is adjustable by means of screw 10. Then fuel and air are sucked in by the idling circuit. Fuel flows from the float chamber N through channel 5, duct 5*a* and jet 30. Air arrives from the air inlet 2 through the calibrated port 44 and apertures 45. The air-fuel mixture which is formed in the upstream part of duct 31 is fed through duct 31, jet 32, hollow screw 22 and channel 7 and emerges into induction passage 1 through port 9. The amount of idling mixture is adjusted by rotating screw 10 for proper operation of the engine.

If butterfly valve 3 is partially opened for loading the engine, ports 8 pass downstream of the upper edge of the butterfly valve 3 and supply an additional amount of air/fuel mixture required for proper operation of the engine.

If the engine is further loaded by opening the butterfly valve 3, the amount of depression transmitted to the main fuel jet circuit becomes sufficient to prime it; from that moment, the depression in apertures 46 sucks in fuel from the float chamber, through channel 5, duct 5*a* calibrated by jet 30, annular space 40 and apertures 46; simultaneously emulsion air arrives in the annular space through calibrated hole 44, central passage 43 and holes 45. Air and fuel form a primary mixture fed to the throat of the main venturi through apertures 46.

Numerous variations are possible within the scope of the invention. For instance the main jet 30 may be replaced or associated with an electromagnetic valve whose control circuit is for example as described in French published patent application No. 78 06715 and supplies pulses at a frequency which is advantageously greater than 10 Hz to avoid appreciable flow fluctuations.

Since the invention provides a compact block carrying all mixture metering or control means (for instance calibrated ports) defining the air and fuel flow characteristics of the carburettor a simple carburettor construction is achieved. Furthermore, the overall amount of fuel and air/fuel mixture contained in the main jet system downstream of the main fuel control device (main jet 30 in the figure) is smaller than that contained in the usual jet systems. As a result, fluctuations in the flow of the jet system during priming are attenuated and the distorsion of the pressure signal during full load operation, with throttle member 3 wide open, is decreased. It will further be appreciated that the various flow passages may be distributed in the block in a number of possible ways and may for instance be formed in one and the same arm.

I claim:

1. A carburettor for an internal combustion engine, comprising:

a carburettor body, an induction passage formed in said body and provided with a venturi portion, a distribution block arranged and dimensioned for insertion and removal through said induction passage to and from a service position in said fuel induction passage, in the vicinity of said venturi, means for removably securing said distribution block in said service position, a main fuel delivery circuit for normal running comprising passage means formed in said body and main fuel metering means, said main metering means being, entirely located in said distribution block and arranged for connection with said passage means when said block is at said service location, there being no main fuel metering means upstream of said main fuel metering means, at least one auxiliary circuit for supplying to the engine a flow of fuel/air mixture for low speed and idle operation of the engine, comprising supplemental passage means formed in said body and supplemental fuel metering means, said supplemental metering means being entirely located in said distribution block and arranged for connection with said supplemental passage means when said block is at said service location, whereby said distribution block including all fuel metering means of said carburettor may be removed or replaced by another block without dismantling the carburettor.

2. Carburettor as claimed in claim 1, wherein said block comprises a part provided with arms arranged for being supported on the body of the carburettor, one of which is formed with a fuel feed passage and carries main fuel metering means and the other of which is formed with a passage for supplying the auxiliary circuit and carries an idling jet.

3. Carburettor as claimed in claim 2, wherein the main fuel metering means is a jet.

4. Carburettor as claimed in claim 2, wherein the main fuel metering means is an electromagnetic valve controlled by a width modulated signal of variable duty ratio.

5. Carburettor as claimed in claim 2, wherein said part has a central cavity in which is placed an air supply end-piece formed with a central passage for admitting emulsion air through a calibrated hole.

6. Carburettor as claimed in claim 5, wherein said main fuel metering means opens into an annular passage defined by the part and the end-piece.

7. Carburettor as claimed in claim 1 wherein said means for removably securing said distribution block is actuatable from outside the carburettor without dismantling of the carburettor.

8. Carburettor for an internal combustion engine, comprising;

a carburettor body, an induction passage formed in said body and provided with a venturi portion, a distribution block arranged and dimensioned for insertion and removal through said induction passage to and from a service position in said fuel induction passage in the vicinity of said venturi, having a part provided with arms arranged for being supported by said carburettor body which block is secured to the carburettor body by a hollow screw projecting into one of the arms and removal of which allows the block to be removed, a main fuel delivery circuit for normal running comprising passage means formed in said body and distribution block and main fuel metering means, said main metering means being located in one of said arms in said distribution block and arranged for connection with said passage means when said block is at said service location, at least one auxiliary circuit for supplying to the engine a flow of fuel/air mixture for low speed and idle operation of the engine, comprising supplemental passage means formed in said body and supplemental fuel metering means, said supplemental metering means being located in another of said arms in said distribution block and arranged for connection with said supplemental passage means when said block is at said service location, whereby said distribution block including all said fuel metering means may be removed or replaced by another block without dismantling the carburettor.

9. Carburettor as claimed in claim 8, wherein the hollow screw forms a supply passage for the auxiliary circuit and is situated between the idling jet and an idling channel in the body of the carburettor.

* * * * *